United States Patent [19]

Hahm

[11] Patent Number: 4,719,173

[45] Date of Patent: Jan. 12, 1988

[54] PROCESS FOR MULTISTAGE CONTACTING

[75] Inventor: Paul T. Hahm, Hilton, N.Y.

[73] Assignee: Eastman Kodak Company, Rochester, N.Y.

[21] Appl. No.: 784,981

[22] Filed: Oct. 7, 1985

[51] Int. Cl.[4] ..... G03C 7/00; G03C 5/24; G03C 5/38

[52] U.S. Cl. ..... 430/398; 134/122 R; 354/324; 430/357; 430/399; 430/400; 430/403

[58] Field of Search ..... 430/398, 399, 400; 430/403, 357; 354/324; 134/122

[56] References Cited

U.S. PATENT DOCUMENTS

| | | | |
|---|---|---|---|
| 3,329,542 | 7/1967 | Stiehl | 156/19 |
| 3,623,416 | 11/1971 | Anderberg | 95/93 |
| 3,879,203 | 4/1975 | Schranz et al. | 430/400 X |
| 3,922,702 | 11/1975 | Gaskell | 354/321 |
| 3,970,457 | 7/1976 | Parsonage | 430/398 X |
| 4,039,349 | 8/1977 | Kwasnoski et al. | 134/10 |
| 4,065,313 | 12/1977 | Shippey | 430/400 X |
| 4,336,324 | 6/1982 | Koboshi et al. | 430/421 X |

*Primary Examiner*—P. R. Michl
*Assistant Examiner*—Mukund J. Shah
*Attorney, Agent, or Firm*—Alfred P. Lorenzo

[57] ABSTRACT

A novel process and apparatus for multistage contacting of two materials advantageously provides high chemical efficiency and low losses of components of one of the materials caused by that material being carried out of the process with the other material. The process comprises contacting, in a series of stages, a first material with a second material containing a component whose concentration therein is reduced by such contact. Replenishment material is introduced to at least one of the stages to compensate for such concentration reduction. The concentration of the component in the second material is highest in one of the stages, and the first material carries a part of the second material out of each stage. The first material is contacted with the second material at least one once in each stage of the series. Contacting is done in a sequential manner such that, in respect to the first material, contacting occurs in at least one of the stages other than the stage having highest component concentration, then in the stage having highest component concentration, and then in at least one of the stages other than the stage having highest component concentration. Replenishment material is introduced to the stage having highest compnent concentration. Second material is transferred from the stage having highest component concentration to at least one of the other stages.

11 Claims, 15 Drawing Figures

PROCESS FOR MULTISTAGE CONTACTING

FIELD OF THE INVENTION

This invention relates in general to processes and apparatus for effecting multistage contacting, for example, liquid-liquid, liquid-solid, or gas-solid contacting, and in particular to a novel process and apparatus for multistage contacting which provides enhanced overall efficiency of operation.

BACKGROUND OF THE INVENTION

Contacting processes for the purpose of exposing a first material to components contained in a second material are widely used. Some examples of such processes include treating photographic materials with photographic processing solutions; etching metal parts in acid baths; tanning leather; washing, bleaching, and dying of fabrics; and metal plating. These processes can be single stage batch contacting processes, but when practiced on a large scale, are generally single or multi-stage continuous contacting processes. The stages, as defined herein, are either actual discrete areas of contact or mathematically computed theoretical stages in a continuous contacting system which mathematically correspond to actual discrete stages.

When the nature of the materials to be contacted is such that the first material carries some of the second material out of the process, some of the components of the second material are lost. This loss is referred to hereinafter as "carryout". Thus, when the first material is a solid and the second material is a liquid, carryout as referred to herein means a loss that occurs when liquid and its associated components are carried out of the process with the solid.

When the nature of the materials is such that components of the second material are utilized in a reaction with at least some part of the first material, the concept of chemical efficiency is useful in evaluating the performance of a contacting process.

The effects of a difference in chemical efficiency between two continuous steady-state prior art contacting processes can be seen by comparing a known single stage contacting process with a known cocurrent multistage contacting process. While any types of material may be contacted in these processes, for the sake of convenience, the processes will be compared with reference to their use in exposing a solid first material to components contained in a liquid second material.

In the single stage process, the solid and liquid are fed at certain rates into a single well-mixed stage, which has uniform concentrations of liquid components throughout the stage. Since the stage is at steady state, the rates of solid and liquid leaving the stage plus any usage of materials or components thereof due to chemical reactions, evaporation, etc. . . . must equal the rates of materials entering the stage.

In the cocurrent multistage process, a series of stages such as the single stage described above is used. The solid and liquid are fed at certain rates into the first well-mixed stage of the series. The liquid and solid leving the first stage are fed into the second stage. The liquid and solid leaving the second stage are fed into the third stage and so on until the liquid and solid leave the last stage of the process.

For purposes of comparing the chemical efficiency of single stage and cocurrent multistage processes, it will be assumed that there is usage of one of the components in the liquid by reaction with the solid or one of its components and that the rate of reaction is proportional to the concentration of the reacting materials. Furthermore, it will be assumed that the reaction is occurring in each stage of the cocurrent process. In other words, the reaction, if it goes to completion, does not do so until the last stage of the process. If this last assumption were not made, every stage after the stage in which the reaction went to completion in a cocurrent process would be redundant (with no changes occurring from stage to stage) and unnecessary for the analysis.

"Reaction products", as referred to herein, include any components whose concentrations are intended to be increased in one of the materials due to contacting. The term is intended herein to include not only products of chemical reactions, but also components whose concentrations are increased in one material as they desirably transfer to that material from the other material. For example, a "reaction product" with respect to the solid may be a component whose concentration in the liquid is reduced as the component is absorbed by the solid. Thus, with respect to the liquid, that same component may be considered a "reactant", a term intended to include any component whose concentration is desirably decreased in one of the materials due to the contacting process. "Reactants" include components whose concentration in one material is decreased by desired chemical reaction, desired transfer to the other material, or both.

Given the described processes and assumptions, the cocurrent multistage process is more chemically efficient that the single stage process. The definition of "more chemically efficient" will be discussed hereinbelow in an analysis of three variables: (1) contacting time (i.e., the amount of time the solid must spend in contact with the liquid in the process), (2) required input rates of materials and components thereof (i.e., solid input or liquid replenishment) to achieve the desired output of products, and (3) the percent completion of reaction achieved. The analysis is performed by holding two of the variables constant and observing how the third variable changes between one system and the other. Beneficial changes in such variables occur when one changes to a more chemically efficient process.

If the percent completion of reaction and the input rates are held constant, the required contacting time will be shorter in the cocurrent process than in the single stage process. This means that less total material need be actually in the cocurrent process at any instant, as compared to the single stage process. This allows concomitant benefits of less equipment or smaller and/or less complicated equipment and easier startup of the process. A simple mass balance indicates that under these conditions, carryout and the amount of components in the materials leaving the processes are the same for both processes. Alternatively, the shorter contacting time may be realized by increasing both the input rates of materials or components thereof and the output rates of the desired products.

If the contacting time and the input rates are held constant, cocurrent processing will achieve a higher percent completion of reaction than single stage processing. This has the additional effect of causing lower carryout of reactants, higher production and carryout of reaction products, and lower reactant concentration in the materials leaving the process than in the single stage process.

If the percent completion of reaction and the contacting time are held constant, the input rates required to achieve the same reaction product rates will be lower for the cocurrent process than for the single stage process. The lower input rates of the cocurrent process are achieved by lowering the flow rates of the materials or by lowering the concentrations of the reactants in the materials. In each case, reactant carryout and the amount of reactants in the materials leaving the process will be lower in the cocurrent process.

Another continuous multistage prior art contacting process is the counter-current process. In this process, the solid is introduced into the first of a series of stages in which it contacts the liquid. The solid that leaves the first stage enters the second and so on to the last stage of the series from which it leaves the process. The liquid replenishment is introduced into the last stage of the series, and then flows into the next to last stage and so on until it enters the first stage of the series, from which it leaves the process.

The counter-current process has a higher carryout loss of liquid reactants than either the cocurrent or single stage processes. It has a higher chemical efficiency than the single stage process, thus providing the same types of benefits as discussed above for the cocurrent process in the cocurrent vs. single stage analysis. This advantage of the counter-current process over the single stage process in chemical efficiency can, as discussed above, tend to decrease somewhat the higher carryout loss under some operating conditions. The counter-current process does not have a clear advantage or disadvantage in chemical efficiency when compared to the cocurrent process. The results of such a comparison vary with the particular type of reaction occurring, properties of the materials involved and operating parameters chosen.

In all multistage contacting systems, chemical efficiency tends to be increased by increasing the number of stages even though the total contacting time remains the same. This is the primary reason for the relatively high chemical efficiency of cocurrent and counter-current processing as opposed to single stage processing. This gain in efficiency is taken to its theoretical limit when an infinite number of stages are used with an infinitesimally small change in component concentration between stages.

Attempts have been made to decrease chemical carryout losses in the above-described processes. Various well-known methods to decrease the amount of a liquid carried out of the process on a solid have been used in the photographic processing field. These methods include the use of a squeegee coupled with a runoff into the processing tank to reduce the amount of processing solution carried out on the photographic film and the use of an air knife to reduce the amount of liquid clinging to the film. These techniques do not prevent chemical component losses due to liquid being absorbed by the solid and are relatively ineffective if the solid is of a shape that does not lend itself well to a physical scraping or cleaning.

Techniques involving rinsing a solid after contacting coupling with a recovery of the components rinsed off the solid have also been used to decrease chemical component losses. U.S. Pat. No. 3,329,542 discloses as prior art the use, in etching of metal in acid baths, of a pre-rinse tank after the metal is etched in the acid bath, but before it undergoes final rinsing. The contents of the pre-rinse tank are then used for replenishment of the etching bath. The process disclosed as the invention of the above-mentioned patent involves spraying metal wire or ribbon with water as it emerges from the etching bath. The wire or ribbon is given helical turns so that the rinse spray runs down the wire or ribbon into the etching bath. The amount of water sprayed onto the metal corresponds to the amount of water loss from the etching tank. Rinsing techniques may, however, be ineffective against carryout loss due to absorption of the liquid into the solid. Additionally the above-described techniques all require the addition to the process of extra equipment and are often difficult to operate and control.

Clearly, there is a need for a contacting process that provides high chemical efficiency and low carryout of valuable components in the liquid carried out of the process with the solid. Such a system could be used by itself or in conjunction with the above-described techniques for reducing carryout loss. It is toward this objective that the present invention is directed.

SUMMARY OF THE INVENTION

The present invention provides a multistage contacting process and apparatus capable of yielding a combination of high chemical efficiency and low carryout loss heretofore unavailable in the art. The process of the invention is hereinafter referred to as contraco processing, to distinguish it from both cocurrent processing and counter-current processing. This process comprises contacting in a series of stages, a first material with a second material containing a component whose concentration therein is reduced by such contact. Replenishment material is introduced to at least one of the stages to compensate for such concentration reduction. The concentration of the component in the second material is highest in one of the stages, and the first material carries a part of the second material out of each stage. The first material is contacted with the second material at least once in each stage of the series. Contacting is done in a sequential manner such that in respect to the first material, the contacting occurs in at least one of the stages other than the stage having highest component concentration, then in the stage having highest component concentration, and then in at least one of the stages other than the stage having highest component concentration. Replenishment material is introduced to the stage having highest component concentration. Second material is transferred from the stage having highest component concentration to at least one of the other stages.

In one use of this invention, the first material is a solid and the component-containing second material is a liquid.

In another use, the first material is a photographic element and the second material is a photographic processing solution.

BRIEF DESCRIPTION OF THE DRAWINGS

FIGS. 1, 2 and 3 represent the prior art contacting process configurations of single stage, counter-current flow, and cocurrent flow, respectively.

FIGS. 4–6 and 8 represent some alternative embodiments for three-stage contraco contacting processes of the invention.

FIG. 7 represents a two-stage contraco contacting process configuration in accordance with the invention.

FIG. 9 represents a six-stage contraco contacting process configuration in accordance with the invention.

FIG. 10 represents a five-stage photographic color developer contraco process configuration of the invention.

FIG. 11 represents a three-stage photographic bleach-fix contraco process configuration of the invention.

FIG. 13 represents a two-stage contraco process configuration of the invention used and compared to the prior art in Examples 1–2.

FIG. 14 represents a two-stage counter-current prior art processing configuration as used for comparison in Examples 1–2.

FIG. 15 represents a two-stage cocurrent prior art processing configuration as used for comparison in Examples 1–2.

DESCRIPTION OF THE PREFERRED EMBODIMENTS

Figure 1:
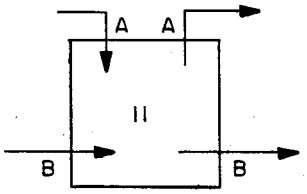
PRIOR ART FIG. 1
FIGS. 1–11 and 13–15 of the drawings are flow diagrams representing material flow paths and stages of contact for processes of contacting diverse materials in accordance with the invention or the prior art.

The present invention can be used in conjunction with any contacting process in which it is desirable to provide high chemical efficiency and low carry-out loss of components contained in one of the materials. this invention can be utilized with many types of processes such as the contacting of gas and liquid, gas and solid, two insoluble liquids, or two solids; however, for convenience of description it will be described primarily in terms of a method of contacting a solid photographic element (the first material) with a processing liquid (the second material). The discussion relative to this use is also applicable to all other uses.

The invention will be further understood by reference to the drawings. FIGS. 2–6 and 8 each show three-stage contacting processes. The number of stages shown is merely for convenience of illustration and not intended to be limiting as to the scope of the invention. Any number of stages greater than one may be used in the practice of the invention. For example, two stages may be used as shown in FIG. 7 or any greater number of stages may be used, such as the six-stage process of FIG. 9. Also, although the drawings show liquid-solid contacting, this is merely done for convenience of description and any types of materials may be contacted. Furthermore, though the stages as shown in the drawings are separate, discrete well-mixed areas of contact, the term "stages" as used herein includes theoretical mathematically defined stages. Such theoretical stages are used in the modeling of processes in which the materials to be contacted are in constant contact, such as in a tubular or plug-flow reactor as described in Fogler, *The Elements of Chemical Kinetics and Reactor Calculations,* Prentice-Hall, Englewood Cliffs, N.J. 1974.

FIG. 1 represents a prior art continuous single stage contacting process. Both liquid A and the solid B enter, are contacted in, and leave only one stage, stage 11.

Figure 2:
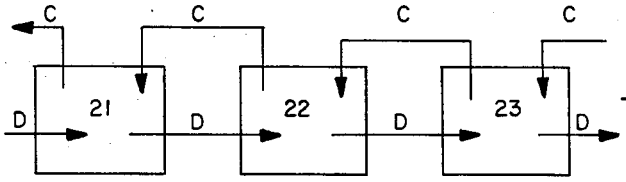
PRIOR ART FIG. 2

FIG. 2 represents a prior art continuous three-stage counter-current contacting process. Solid D enters stage 21 from which it proceeds to stage 22 and then to stage 23, from which it leaves the process. Liquid C enters stage 23 from which it proceeds to stage 22 and then to stage 21, from which it leaves the process. The liquid has the highest concentration of reactants in stage 23 and the lowest in stage 21, while having the highest concentration of reaction products in stage 21 and the lowest in stage 23. The solid first contacts liquid with a low concentration of reactants and proceeds to contact liquid having progressively higher concentrations of reactants.

Figure 3:
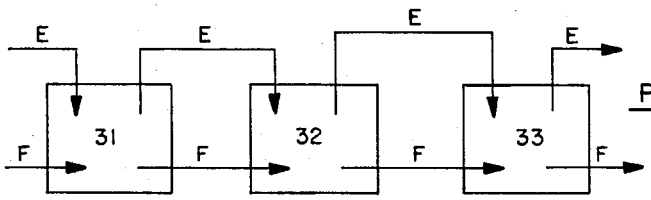
PRIOR ART FIG. 3

FIG. 3 represents a prior art continuous three-stage cocurrent contacting process. Solid F and liquid E both enter stage 31 from which they proceed to stage 32 and then to stage 33, from which they leave the process. The liquid has the highest concentration of reactants in stage 31 and the lowest in stage 33, while having the highest concentration of reaction products in stage 33 and the lowest in stage 31. The solid first contacts liquid having a high concentration of reactants and proceeds to contact liquid having progressively lower concentrations of reactants.

Figure 4:
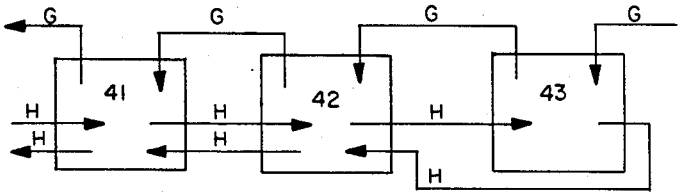
Figure 5:
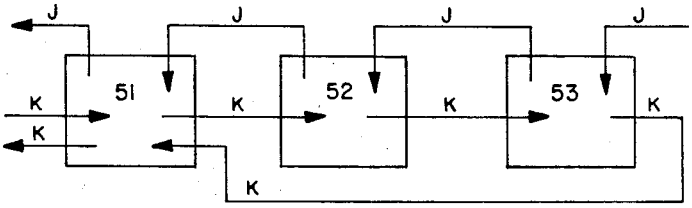

FIGS. 4 and 5 represent three-stage continuous contracto contacting processes according to the invention. In both Figures, liquid G or J enters the process at stage 43 or 53, respectively, from which it flows to stage 42 or 52 and then to stage 41 or 51, from which it leaves the process. The liquid has the highest concentration or reactants in stage 43 or 53 and the lowest in stage 41 or 51, while having the highest concentration of reaction products in stage or 41 or 51 and the lowest in stage 43 or 53. In FIG. 4, solid H enters the process at stage 41 from which it moves to stage 42, to stage 43, back to stage 42 and then again to stage 41, from which it leaves the process. In FIG. 5, solid K enters the process at stage 51 from which it moves to stage 52, to stage 53, and then again to stage 51, from which it leaves the process. In both FIGS. 4 and 5, the solid contacts the liquid first in at least one stage (stages 41 or 51, and 42 or 52) other than the stage having highest reactant concentration, then in the stage having highest reactant concentration (stage 43 or 53), and then in at least one stage (stages 42 and 41 in FIG. 4 and stage 51 in FIG. 5) other than the stage having highest reactant concentration.

Figure 6:
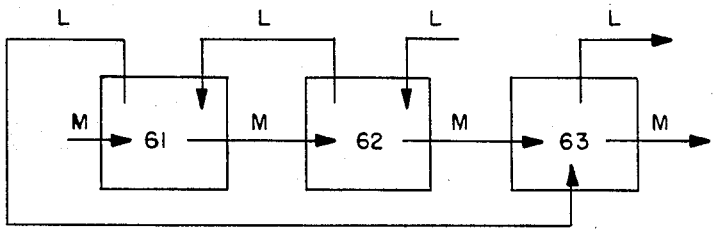
Figure 7:
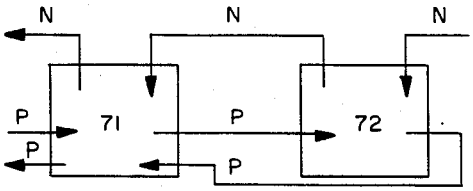

FIG. 6 also represents a three-stage continuous contraco contacting process according to the invention. Liquid L enters the process at stage 62 from which it flows to stage 61 and then to stage 63, from which it leaves the process. The liquid's reactant concentration is highest in stage 62 and lowest in stage 63, while its reaction product concentration is highest in stage 63 and lowest in stage 62. Solid M enters the process at stage 61 from which it moves to stage 62 and then to stage 63, from which it leaves the process. The solid contacts the liquid in at least one stage (stage 61) other than the stage having highest reactant concentration, then in the stage having highest reactant concentration (stage 62), and then in at least one stage (stage 63) other than the stage having highest reactant concentration.

Figure 8:
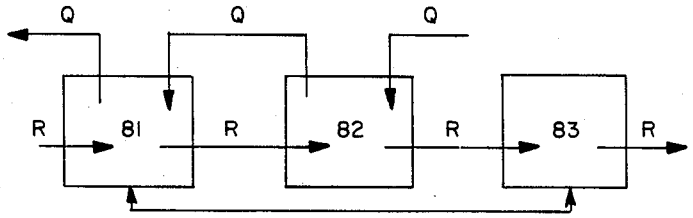

FIGS. 7 and 8 represent, respectively, two and three-stage continuous contraco contacting processes according to the invention. In both figures, liquid N or Q enters the process at stage 72 or 82, respectively, and then flows to stage 71 or 81, from which it leaves the process. In FIG. 8, stages 81 and 83 comprise two containers between which liquid Q is recirculated so that component concentration in the liquid is virtually the same in both stages 81 and 83. In both figures, the concentration of reactants in the liquid is highest in stage 72 or 82 and lowest in stage 71 or 81 and 83, while the concentration of reaction products in the liquid is highest in stage 72 or 82 and lowest in stage 71 or 81 and 83.

In FIG. 7, solid P enters the process at stage 71 from which it moves to stage 72 and then back to stage 71, from which it leaves the process. In FIG. 8, solid R enters the process at stage 81 from which it moves to stage 82 and then to stage 83, from which it leaves the process. In both processes, the solid contacts the liquid first in a stage (stage 71 or 81) other than the stage having the highest reactant concentration, then in the stage having the highest reactant concentration (stage 72 or 82), and then in a stage (stage 71 or 83) other than the stage having the highest reactant concentration.

Figure 9:
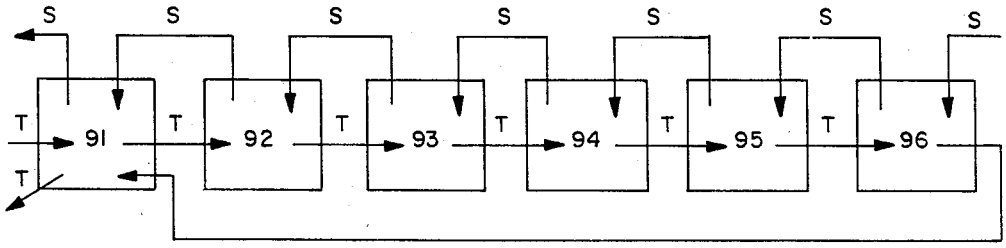

FIG. 9 represents a six-stage continuous contraco contacting process according to the invention. Liquid S enters the process at stage 96, from which it flows successively to stage 95, to stage 94, to stage 93, to stage 92, and then to stage 91, from which it leaves the process. The liquid has its highest reactant concentration in stage 96 and its lowest in stage 91, and has its highest reaction product concentration in stage 91 and its lowest in stage 96. Solid T enters the process at stage 91, from which it moves successively to stage 92, to stage 93, to stage 94, to stage 95, to stage 96, and then again to stage 91, from which it leaves the process. The solid contacts the liquid first in at least one stage (stages 91–95) other than the stage having highest reactant concentration, then in the stage having highest reactant concentration (stage 96), and then in at least one stage (stage 91) other than the stage having highest reactant concentration.

Figure 10:
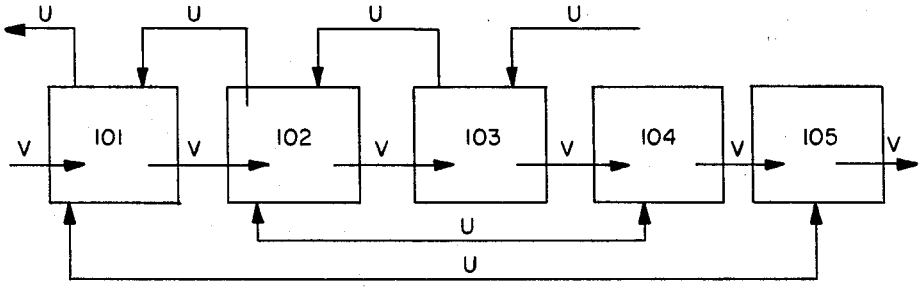

FIG. 10 represents a preferred embodiment of a five-stage continous contraco contacting process in accordance with the invention for developing a visible image in a photographic element. Developing solution U containing developing agent enters stage 103, from which it flows to stage 102 and then to stage 101, from which it leaves the process. Developing solution U is recirculated between stages 101 and 105, and between stages 102 and 104 so that component concentration in the developing solution is virtually the same in stage 101 as in stage 105, and virtually the same in stage 102 as in stage 104. Photographic element V enters the process at stage 101, from which it moves successively to stage 102, to stage 103, to stage 104, and then to stage 105, from which it leaves the process. Photographic element V contacts the developing solution first in at least one stage (stages 101 and 102) other than the stage having the highest developing agent concentration, then in the stage having the highest developing agent concentration (stage 103), and than in at least one stage (stages 104 and 105) other than the stage having highest developing agent concentration. The concentration of developing agent (reactant) in the developing solution is reduced by contacting the photographic element with the solution and is highest in stage 103 and lowest in stages 101 and 105.

Figure 11:
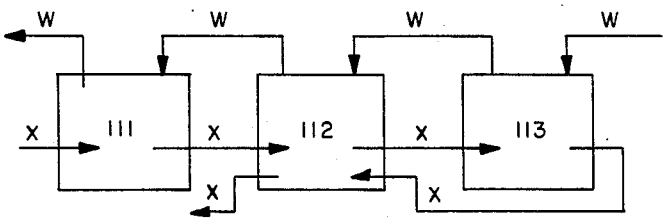

FIG. 11 represents a preferred embodiment of a 3-stage continuous contraco contacting process in according with the invention for bleach-fix processing of a photographic element to transfer silver from the element into a bleach-fix solution. Bleach-fix solution W enters stage 113 from which it flows to stage 112 and then to stage 111, from which it leaves the process. The concentration of bleach-fix agents (reactants) in the solution is reduced by contact with the photographic element and is highest in stage 113 and lowest in stage 111. The concentration of silver, a reaction product, in the solution is highest in stage 111 and lowest in stage 113. Photographic element X enters the process at stage 111, from which it moves successively to stage 112, to stage 113, and then again to stage 112, from which it leaves the process. The photographic element X contacts the bleach-fix solution first in at least one stage (stages 111 and 112) other than the stage having the highest concentration of bleach-fix agents, then in the stage having the highest concentration of bleach-fix agents (stage 113), and then in at least one stage (stage 112) other than the stage having the highest concentration of bleach-fix agents. As compared to a counter-current configuration, which is normally used in the prior art because it minimizes silver carryout loss, this contraco processing configuration provides lower carryout loss of bleach-fix agents (reactants) while still providing an acceptably low carryout loss of silver (a reaction product) without requiring an excessive number of stages.

The contraco process according to the invention offers the advantages over prior art contacting processes of providing higher chemical efficiency and/or lower carryout loss of liquid components.

As compared to a single stage process, contraco processing has a higher chemical efficiency. In this respect the advantages offered by the contraco process over the single stage process are similar to those of the cocurrent process as described hereinbefore using an analysis of the three variables of contacting time, required input rates, and percent completion of reaction.

As compared to counter-current processing, contraco processing has a lower carryout loss of the liquid's reactants. Also, in many circumstances contraco processing has a higher chemical efficiency than counter-current processing, which would provide all the same advantages set forth for the cocurrent process in the cocurrent vs. single stage analysis. Contraco processing will generally have a higher chemical efficiency than counter-current processing in processes where initial contact with the solid causes a decrease in component concentration in the liquid. This concentration reduction can occur through dilution of the component-containing liquid by some other liquid carried into the process with the solid. The concentration reduction can also occur through a reaction of the liquid's reactant(s) with the solid's reactant(s) or with any components or some other material carried into the process by the solid.

As compared with cocurrent processing, contraco processing has a higher chemical efficiency than the cocurrent process in some situations where the solid reduces the reactant concentration of the liquid in the stage where, with respect to the solid, contacting first occurs. The greater this reduction a reactant concentration in the liquid, the higher the chemical efficiency of the contraco process will generally be relative to the cocurrent process. The degree of reactant concentration reduction in the liquid in the first contacting stage necessary to endow the contraco process with a higher chemical efficiency than the cocurrent process varies depending on the particular characteristics of the materials and their possible and desired interactions. However, it is easy to determine which of the two processes is more efficient in a given situation by performing mass balances on any particular contraco and cocurrent processes having equal contacting times, an equal number of stages, and equal rates of input of the same materials. The process that provides more conversion of reactants to products is the more chemically efficient process of the two.

The contraco contacting process's advantages of higher chemical efficiency and/or lower carryout losses in comparison to the prior art single stage, counter-current, and cocurrent contacting processes may be utilized in the form of alternative benefits by changing process variables, alternatively, alone, or in combination in the same manner as described in the single stage vs. cocurrent analysis described hereinbefore. If percent completion of reaction and liquid input rates are held constant, less equipment and easier startup of process or higher solid input and output rates are achieved. These benefits result from the shorter contacting time required in the contraco process because of its higher efficiency. If the contacting time and input rates are held constant, higher percent completion of reaction and component savings are realized, due to higher chemical efficiency and lower carryout. Finally, if percent of reaction completion and the contacting time are held constant, direct savings in materials are realized due to lower liquid component input rates and lower carryout loss.

Lower liquid component input rates can be effected by lowering the liquid flow rate, lowering reactant concentrations in the liquid input, or both. Lowering liquid flow rates is the more chemically efficient way of utilizing the advantages of contraco processing, but maintaining high flow rate while lowering component concentration in the liquid input may be necessitated if the concentration of any deleterious reaction side products must be kept low. Combinations of the above advantages can be obtained by allowing all three variables to change. As with all multistage contacting processes, the chemical efficiency of the contraco process increases as the number of stages is increased while maintaining contacting time constant. Thus, the comparisons made herein among contraco processing, counter-current processing, and cocurrent processing are made on the assumption that all the processes have an equal number of stages.

Apparatus utilized in the practice of the invention is adapted to provide contacting, in a series of stages, of a first material with a second material containing at least one component whose concentration therein is reduced by such contact. The apparatus can comprise a plurality of containers for containing the first and second materials during the contacting and means for introducing replenishment material to one of the containers to compensate for the component concentration reduction. The introduction of replenishment material causes reactant concentration in the second material to be highest in that container. The apparatus further comprises means for transferring second material from the stage having highest compound concentration to at least one of the other stages. The apparatus also comprises means for bringing the first material into contact with the second material at least once in each of the containers such that in respect to the first material, the contacting occurs in at least one of the containers other than that having highest component concentration, then in the container having highest component concentration, and then in at least one of the containers other than that having highest component concentration. Suitable containers include enclosed tanks, open tanks, hoppers, pipelines, and numerous other types of vessels. The choice of containers depends on the properties of the process and of the materials to be contracted.

The means for introducing replenishment material to the process may be any of a number of well known modes of material transport. For example, the means for introducing replenishment material may be a pipe if the replenishment material is gaseous; a pipe, trough, or channel if the replenishment material is a liquid; a pipe, trough, chute or conveyer belt if the replenishment material is a particulate solid; or a drive mechanism and series of rollers and guides if the replenishment material is a solid web.

The means for contacting the materials in the order as stated hereinbefore are generally the same types of modes of transport as the replenishment material introducing means described above. These means also include overflow weirs for liquid materials. The pipes, troughs, channels, conveyer belts, rollers and guides, etc. . . . are arranged so that the materials move in such a manner as to cause contacting to occur in the order described.

In one of the preferred embodiments, an apparatus according to the invention is useful for contacting a solid with a liquid containing at least one component whose concentration therein is reduced by such contact. In such an apparatus, the desired contacting order can be achieved by allowing the liquid to flow successively from one container or stage to the next, such as with the use of overflow weirs, and causing the solid to move through the necessary containers, through the use of, for example, a series of rollers and guides for a solid web. this is seen in the process configurations of FIGS. 4, 5, 7, and 9. Alternatively, the solid may move successively through the series of stages while the liquid flow follows a path, such as through the use of pipes, that achieves the desired contacting order. This is seen in the process configurations shown in FIGS. 6 and 8. Numerous other processing configurations may be used in the apparatus of the invention. Although these drawings show the solid travelling in a straight line through the stages, they are meant only to show the order in which the solid moves between stages. The solid may follow any path within or between stages as long as it enters the proper stage in the proper sequence.

Figure 12:
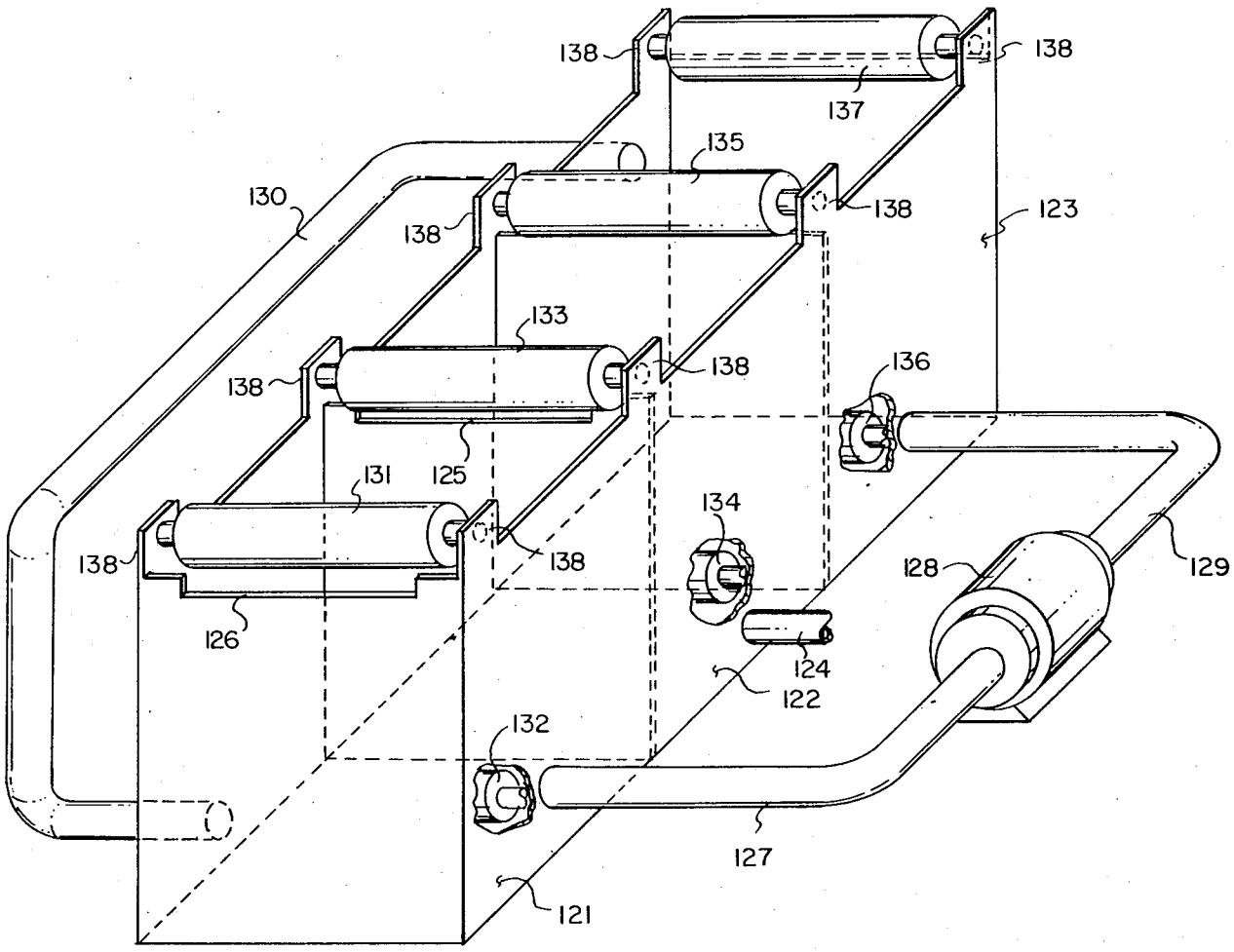
FIG. 12 represents an apparatus according to the invention for contacting a web solid material with a liquid material.

An apparatus according to the invention is shown in FIG. 12. This apparatus is useful for contacting a web solid, such as a photographic element, with a liquid processing solution having one or more components whose concentration is reduced by such contact, such as a photographic developing solution. The apparatus comprises three containers: 121, 122, and 123. Replenishment liquid is introduced to container 122, which has a higher component concentration than the other containers, through pipe 124. Liquid is transferred from container 122 to container 121 via an overflow weir 125. Liquid is pumped from container 121 to container 123 through pipes 127 and 129 by a pump 128. Liquid leaves container 123 via pipe 130, flowing into container 121.

The liquid flow through pipes 127, 129, and 130 creates recirculation between containers 121 and 123, so that liquid component concentration is virtually the same in both containers 121 and 123. Liquid leaves the apparatus via overflow weir 126. The web solid is contacted with the liquid in each of the containers 121–123 by being passed over a series of rollers 131–137, which are driven by a number of drive mechanisms 138. The solid enters container 121 and contacts the liquid therein by passing over rollers 131 and 132. The solid moves out of container 121 into container 122 and contacts the liquid therein by passing over rollers 133 and 134. The solid then moves out of container 122 into container 123 and contacts the liquid therein by passing over rollers 135 and 136. Finally, the solid leaves the apparatus by passing over roller 137.

The presence of several factors indicate situations where practice of the invention may be advantageous. First, there should be a reduction of concentration in the liquid component(s) caused by the contacting. This can be caused by consumption due to a chemical reaction and/or by dilution caused by the solid carrying other non-component-containing liquid (such as rinse liquid from a prior process) into the process.

The reduction in liquid component concentration caused by the contacting necessitates the introduction to the process of replenishment material. This material may be component-containing liquid or it may be the components in pure or concentrated form. The introduction of replenishment material and the component concentration reduction occurring during the process cause the liquid component concentration to be highest in the stage to which the replenishment material is introduced. The replenishment material may make up the entirety of the liquid fed to the process or it may be combined with recycled liquid to make up the liquid fed to the process.

If it is desired to conserve valuable reaction products formed in the process, the present invention allows one to optimally adjust the relative amounts of both the reaction products and the liquid components that are to be conserved. If the value of the reaction products in the liquid predominates over the value of the liquid reactants, the use of the present invention may be inappropriate as it tends to increase the amount of reaction products in the liquid that is carried out on the solid as opposed to counter-current processing (which would minimize that amount). In such a case, the value of the reaction products lost because of practice of the invention would have to be compared to the liquid components saved, in deciding whether to use the invention.

Several additional factors should be taken into account in the operation of a liquid-solid contraco contacting process in accordance with the invention. These factors include the combination of flow rate and component concentration of the liquid input, the amount of liquid that is carried out of each process stage with the solid, the relative amount of liquid that is recycled, the amount of any replenishment liquid added to the recycle stream, the component concentration of such replenishment liquid, the amount of liquid carried into the process with the solid, and the component concentration of any such liquid carried into the process.

The flow rate and component concentration of the liquid input may be varied to affect the operation of the process. Such variation affects the rate at which the solid material can be fed to the process, the number of stages required to achieve a certain amount of exposure of the solid to the liquid components, the concentration throughout the process of the liquid components, and the concentration throughout the process of any reaction products. Increasing the liquid input rate would allow the same amount of solid to be processed while using a lower concentration of components in the liquid input. This would have the effect of lowering reaction product concentrations in the liquid. Conversely, lowering the liquid input rate while increasing the concentration of components in the liquid input has the effect of increasing reaction product concentration in the liquid. This also makes the process more difficult to control as the liquid input rate becomes lower.

While it is not necessary for the practice of the present invention, in many cases all or part of the liquid stream leaving the process can be recycled and reused as liquid replenishment. Normally, replenishment other than a recycle stream will also be required to compensate for losses due to carryout, consumption, and evaporation, or if only part of the liquid leaving the process is recycled. Any such replenishment may be a pure component or a solution of such a component.

As the amount of recycle increases, the concentration of any reaction products in the process also increases. To maintain the concentration of reaction products at an acceptable level, some liquid must be purged out of the system or must be treated to remove the reaction products. This treatment can be performed on the recycle stream or elsewhere in the process. The treatment should be selected to remove the desired reaction products without affecting the liquid components necessary for the contacting processes. Many separation techniques suitable as treatments are well known in the art and include adsorption, filtration, distillation, crystallization, sedimentation and centrifugation.

While not as easily varied as the liquid recycle rate and component concentration, the amount of liquid that the solid can physically carry out of the process also affects the operation of the process according to this invention. The more liquid that the solid carried out of the process, the greater the carry-out loss of liquid components. Similarly, the greater the amount of non-component containing liquid that the solid carries into the process, the greater the dilution effect (i.e. the greater the reduction of reactant concentration in the liquid between the point the liquid enters the process and the point it leaves). Contraco processing may be used in conjunction with any prior art method, such as a squeegee or air-knife, for reducing carry-out loss of the liquid.

Contraco processing is particularly useful when applied to photographic processing. Photographic elements containing latent images from light exposure are generally processed in aqueous processing solutions according to methods well-known in the art. Color photographic elements may be color processed according to one of the following process cycles:

(1) color develop, stop-fix, wash, bleach, wash, hardener-fix, wash, and dry;

(2) color develop, wash, bleach-fix, wash, and dry;

(3) develop, stop, wash, color develop, bleach-fix, wash, and dry; and (4) preharden, neutralize, wash, develop, stop, wash, color develop, bleach-fix, wash, and dry. Black-and-white elements may be processed according to one of the following process cycles:

(1) develop, stop, fix, wash, and dry; and (2) develop, wash, bleach, develop, fix, wash, and dry.

One process step with which contraco processing can be advantageously utilized is color developing. Color developing processes that can effectively utilize contraco processing involve the treatment of the color element containing a latent image with a developing solution generally comprising developing agent, restrainer, and buffer. The photographic element normally has three selectively sensitized silver halide layers coated on one side of a single support. The vehicle used for these emulsion layers is normally a hydrophilic colloid, such as gelatin. One emulsion layer is blue-sensitive, another green-sensitive, and another red-sensitive.

An example of a five stage system that could be used with a color developing process is shown in FIG. 10.

The bleach-fix step of the above-mentioned color processing cycles can also be made more efficient through the use of contraco processing. Bleach-fix processing generally involves treatment of photographic elements with a solution comprising fixing agent, bleaching agent, and preservative. The purpose of the treatment is to reduce the metallic silver contained in the element to silver ion and to complex that ion in solution so the silver can be recovered later from the solution. An example of a three stage contraco process that can be used with a photographic bleach-fix process is shown in FIG. 11.

The present invention can be used with any photographic processing system in which there is a reduction of component concentration in the processing solution. Such a reduction will generally be due either to dilution or component consumption. However, the practice of the invention is not limited to photographic processing or even liquid-solid contacting.

The invention is further illustrated by the following examples of its practice and comparison to the prior art.

EXAMPLES

Two-stage processors are used in the Examples for ease of comparison and do not necessarily represent the most preferred embodiments of the invention.

COMPARATIVE EXAMPLE 1

Figure 13:
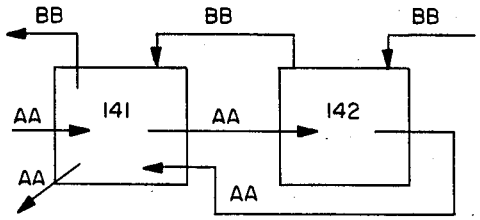
Figure 14:
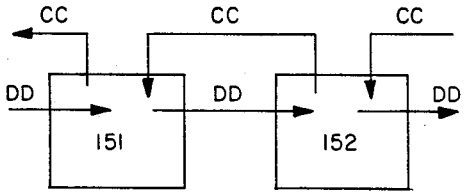
PRIOR ART FIG. 14
Figure 15:
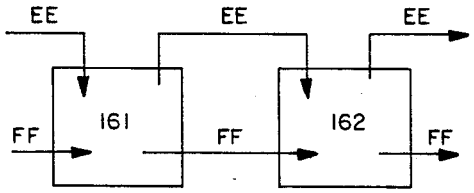
PRIOR ART FIG. 15

Color Paper Photographic Development Process Using Contraco Processing Compared to Prior Art Process Configurations In this process, the paper is dry when it enters the process so no dilution is involved (i.e., the reduction in component concentration is caused by the development reaction). A two-stage photographic developing processor, which operates as shown in FIG. 13, is used for developing Kodak Ektacolor® Paper in accordance with the invention using Kodak Ektaprint 2® process chemistry. The paper AA enters stage 141 and is processed for 95 seconds in solution BB at which time it moves to stage 142 and is processed for 105 seconds. Finally, paper AA returns to stage 141 for 10 seconds of processing, (making a total of 105 seconds of processing in each stage) before leaving the processor. At steady state, the required developer solution replenishment rate is 21.7 $ml/ft^2$ of film. For comparison, a two-stage counter-current processor with solution CC and paper DD as shown in FIG. 14 with 105 seconds of processing in each stage requires a replenishment rate of 24.2 $ml/ft^2$. A two-stage cocurrent processor with solution EE and paper FF as shown in FIG. 15 with 105 seconds of processing in each stage requires a replenishment rate of 27 $ml/ft^2$. A single stage processor with 210 seconds of processing requires a replenishment rate of 33 $ml/ft^2$. The steady state concentrations of developing agent, potassium bromide (a reaction by-product), and benzyl alcohol, along with pH's and replenishment rates are shown in Table 1.

TABLE I

Steady State Stage Concentrations for Development Process

| | Contraco (FIG. 13) | | Counter-Current (FIG. 14) | | Cocurrent (FIG. 15) | | Single Stage |
|---|---|---|---|---|---|---|---|
| Stage | 141 | 142 | 151 | 152 | 161 | 162 | |
| Developing Agent (g/l) | 3.33 | 5.55 | 3.58 | 5.36 | 4.92 | 3.96 | 4.44 |
| Potassium bromide (g/l) | 1.01 | 0.32 | 0.95 | 0.37 | 0.51 | 0.81 | 0.66 |
| Benzyl Alcohol (ml/l) | 12.9 | 16.3 | 12.0 | 16.2 | 14.3 | 14.3 | 14.3 |
| pH | 10.01 | 10.23 | 10.03 | 10.03 | 10.17 | 10.07 | 10.12 |
| Replenishment rate ($ml/ft^2$ | 21.7 | | 24.2 | | 27 | | 33 |

The results shown in Table I demonstrate the greater chemical efficiency (as illustrated by the lower replenishment rate) and the lower carryout loss of developing agent (as illustrated by the lower developing agent concentration in stage 141) made possible through use of the contraco process of the present invention.

COMPARATIVE EXAMPLE 2

Color Paper Bleach-Fix Process Using Contraco Processing Compared to Prior Art Processing Configurations In this process, the spent iron EDTA bleaching agent is regenerated in situ by contact with air. Thus, for the bleaching agent, dilution caused by liquid carried into the process on the photographic paper is the cause of the reduction in component concentration in the processing solution. The concentration of hypo is reduced both by dilution and chemical reaction. Two-stage contraco, countercurrent, and cocurrent processors, as shown in FIGS. 13, 14 and 15, and a single stage processor are used for bleach-fixing Kodak Ektacolor® Paper in using Kodak Ektaprint 2® process chemistry. With the two-stage processors, the paper is processed for 45 seconds in each stage. In the contraco process, the paper AA is processed for 30 seconds when it enters stage 141 the first time, and for 15 seconds when it enters stage 141 for the second time. With the single stage processor, the paper is processed for 90 seconds. The steady state tank concentrations of bleach, hypo, and silver, along with the required bleach-fix solution replenishment rates are shown in Table II.

TABLE II

Steady State Stage Concentrations for Bleach-Fix Process

| | Contraco (FIG. 13) | | Counter-Current (FIG. 14) | | Cocurrent (FIG. 15) | | Single Stage |
|---|---|---|---|---|---|---|---|
| Stage | 141 | 132 | 151 | 152 | 161 | 162 | |
| Bleach (ml/l) | 83 | 147 | 61 | 169 | 115 | 115 | 115 |
| Hypo (ml of 58% | 94 | 166 | 69 | 191 | 130 | 130 | 130 |

TABLE II-continued

| Steady State Stage Concentrations for Bleach-Fix Process | | | | | | | |
|---|---|---|---|---|---|---|---|
| | Contraco (FIG. 13) | | Counter-Current (FIG. 14) | | Cocurrent (FIG. 15) | | Single Stage |
| hypo solution/l) | | | | | | | |
| Silver (g/l) | 9.4 | 7.2 | 10.2 | 6.5 | 8.2 | 8.3 | 8.3 |
| Replenishment rate (ml/ft$^2$) | 2.0 | | 3.7 | | 3.1 | | 3.1 |

The results shown in Table II show the greater chemical efficiency of the contraco process as illustrated by the lower replenishment rate.

The invention has been described in detail with particular reference to preferred embodiments thereof, but it will be understood that variations and modifications can be effected within the spirit and scope of the invention.

What is claimed is:

1. A multistage contacting process wherein a first material is contacted, in a series of stages, with a second material containing at leat one component whose concentration therein is reduced by such contact, wherein: replenishment material is introduced to at least one of the stages to compensate for such concentration reduction; the concentration of the component in the second material is highest in one of the stages; and the first material carries a part of the second material out of each stage, which process comprises:

contacting the first material with the second material at least once in each stage of the series, in a sequential manner such that in respect to said first material, the contacting occurs in at least one of the stages other than the stage having highest component concentration, then in the stage having highest component concentration, and then in at least one of the stages other than the stage having highest component concentration;

introducing the replenishment material to the stage having highest component concentration; and transferring second material from the stage having highest component concentration to at least one of the other stages.

2. the process of claim 1 wherein said series of stages comprises between two and five stages.

3. The process of claim 1 wherein said first material is a solid and said second material is a liquid.

4. The process of claim 1 wherein said first material is a photographic element and said second material is a photographic processing solution.

5. The process of claim 4 wherein said photographic processing solution is a developing solution.

6. The process of claim 4 wherein said photographic processing solution is a bleach-fix solution.

7. The process of claim 4 wherein said photographic processing solution is a bleach solution.

8. A multistage contacting process wherein a solid is contacted, in a series of stages, with a liquid containing at least one component whose concentration therein is reduced by dilution as a result of such contact, wherein: replenishment material is introduced to at least one of the stages to compensate for such concentration reduction; the concentration of the component in the liquid is highest in one of the stages; and the solid carries a part of the liquid out of each stage, which process comprises:

contacting the solid with the liquid at least once in each stage of the series, in a sequential manner such that in respect to said solid, the contacting occurs in at least one of the stages other than the stage having the highest component concentration, then in the stage having highest component concentration, and then in at least one of the stages other than the stage having highest component concentration;

introduction the replenishment material to the stage having highest component concentration; and transferring liquid from the stage having highest component concentration to at least one of the other stages.

9. A multistage contacting process wherein a solid is contacted, in a series of stages, with a liquid containing at least one component whose concentration therein is reduced by consumption as a result of contact, wherein: replenishment material is introduced to at least one of the stages to compensate for such concentration reduction; the concentration of the component in the liquid is highest in one of the stages; and the solid carries a part of the liquid out of each stage, which process comprises:

contacting the solid with the liquid at least once in each stage of the series, in a sequential manner such that in respect to said solid, the contacting occurs in at least one of the stages other than that the stage having highest component concentration, then in the stage having highest component concentration, and then in at least one of the stages other than the stage having highest component concentration;

introducing the replenishment material to the stage having highest component concentration; and transferring liquid from the stage having highest component concentration to at least one of the other stages.

10. A process wherein a color photographic element is contacted, in a series of five stages, with a color developing solution which process comprises:

contacting the element with the solution in a manner such that, in respect to the element, contacting occurs in the first, then the second, then the third, then the fourth, and then the fifth stage of the series;

introducing replenishment developing solution to the third stage of the series, in an amount sufficient to create a flow of developing solution from the third stage;

directing said flow from the third stage to the second stage of the series, thereby causing a flow of the developing solution from the second stage;

directing said flow from the second stage to the first stage of the series;

recirculating developing solution between the second and fourth stages of the series; and recirculating developing solution between the first and fifth stages of the series.

11. A process wherein a color photographic element is contacted, in a series of three stages, with a bleach-fix solution, which process comprises:

contacting the element with the solution in a manner such that in respect to the element, contacting occurs in the first, then the second, then the third, and then the second stage of the series;

introducing replenishment solution to the third stage of the series, in an amount sufficient to create a flow of bleach-fix solution from the third stage;

directing said flow from the third stage to the second stage of the series, thereby causing a flow of solution from the second stage; and directing said flow from the second stage to the first stage of the series.

* * * * *